US008317316B2

(12) United States Patent
Baba et al.

(10) Patent No.: US 8,317,316 B2
(45) Date of Patent: Nov. 27, 2012

(54) INK JET RECORDING APPARATUS

(75) Inventors: Ryo Baba, Hamamatsu (JP); Yusuke Takano, Hamamatsu (JP); Koji Owada, Hamamatsu (JP)

(73) Assignee: Roland DG Corporation, Hamamatsu-Shi (JP)

( * ) Notice: Subject to any disclaimer, the term of this patent is extended or adjusted under 35 U.S.C. 154(b) by 207 days.

(21) Appl. No.: 12/832,893

(22) Filed: Jul. 8, 2010

(65) Prior Publication Data

US 2011/0007119 A1 Jan. 13, 2011

(30) Foreign Application Priority Data

Jul. 9, 2009 (JP) ..... 2009-162564
Sep. 14, 2009 (JP) ..... 2009-211347

(51) Int. Cl.
*B41J 2/01* (2006.01)
*B41J 29/13* (2006.01)

(52) U.S. Cl. ..... 347/104; 347/108

(58) Field of Classification Search ..... None
See application file for complete search history.

(56) References Cited

U.S. PATENT DOCUMENTS

2006/0023024 A1* 2/2006 Niekawa ..... 347/37
2007/0291096 A1* 12/2007 Toyoshima ..... 347/104
2008/0309007 A1* 12/2008 Nagata et al. ..... 271/258.01

* cited by examiner

*Primary Examiner* — Stephen Meier
*Assistant Examiner* — Tracey McMillion
(74) *Attorney, Agent, or Firm* — Lee, Hong, Degerman, Kang & Waimey

(57) ABSTRACT

An ink jet recording apparatus is presented. The ink jet recording apparatus includes an apparatus casing comprising a discharge port which opens in a forward direction, a support member disposed within the apparatus casing in the rear of the discharge port and configured to support a recording medium, an ink head disposed within the apparatus casing and configured to eject ink which is curable with irradiation of ultraviolet light to the recording medium, an ultraviolet light irradiation device disposed within the apparatus casing and configured to irradiate ultraviolet light to the recording medium, and a first cover body configured to cover the discharge port in a freely openable and closeable manner, wherein the first cover body is opened upon discharging the recording medium via the discharge port.

36 Claims, 10 Drawing Sheets

(a)

(b)

INK JET RECORDING APPARATUS

CROSS-REFERENCE TO RELATED APPLICATIONS

Pursuant to 35 U.S.C. §119(a), this application claims the benefit of earlier filing date and right of priority to Japanese Application No. 2009-162564, filed on Jul. 9, 2009 and Japanese Application No. 2009-211347, filed on Sep. 14, 2009, the contents of which are hereby incorporated by reference herein in their entirety.

BACKGROUND OF THE INVENTION

1. Field of the Invention

The present invention relates to an ink jet recording apparatus equipped with a cutting function.

2. Discussion of the Related Art

Conventionally, ink jet recording apparatuses are equipped with an ink head for ejecting ink curable upon irradiation of ultraviolet light, referred to as "ultraviolet light curable ink," and an ultraviolet light irradiation device for irradiating ultraviolet light to ultraviolet light curable ink ejected onto recording medium, such as recording paper. The ink head and the ultraviolet light irradiation device are provided inside an apparatus casing. Irradiation of ultraviolet light by the ultraviolet light irradiation device is performed within the apparatus casing.

The ink jet recording apparatus equipped with the ultraviolet light irradiation device should prevent exposure of the ultraviolet light from the apparatus casing. The ink jet recording apparatus described in Japanese Laid-open Patent Application 2008-100493 is equipped with a guide for guiding the recording medium in a forwardly diagonally downward direction after printing. The ink jet recording apparatus described above is used for printing on soft recording medium such as paper, and the recording medium is discharged from the platen after printing while being curved along the guide. The guide extends in a forwardly diagonally downward direction from the apparatus casing. Therefore, ultraviolet light irradiated from the ultraviolet light irradiation apparatus and travelling in a forward direction is blocked by the guide and is not exposed from the apparatus casing.

Along with diversification of recording media in recent years, printing on recording media composed of hard material, such as glass or metal, by an ink jet recording apparatus has increased in volume. There are difficulties in printing on a hard recording medium, such that it is difficult to discharge the recording medium after printing while being curved along the guide described above. In other words, it is difficult to change the orientation of the transfer path of the recording medium from a horizontal direction to a diagonally downward direction. Accordingly, the guide described above cannot be used, and external leakage of ultraviolet light cannot be prevented by the guide described above.

The present invention has been made in view of the problem described above, and its object is to provide an ink jet recording apparatus that is capable of properly preventing external leakage of ultraviolet light, and is applicable to recording media composed of hard material such as glass and the like.

In accordance with the invention, an ink jet recording apparatus that appropriately prevents external leakage of ultraviolet light and is applicable to recording media composed of hard material, such as a glass plate, can be obtained.

SUMMARY OF THE INVENTION

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In accordance with an embodiment an ink jet recording apparatus is presented. The ink jet recording apparatus includes an apparatus casing comprising a discharge port which opens in a forward direction, a support member disposed within the apparatus casing in the rear of the discharge port and configured to support a recording medium, an ink head disposed within the apparatus casing and configured to eject ink which is curable with irradiation of ultraviolet light to the recording medium, an ultraviolet light irradiation device disposed within the apparatus casing and configured to irradiate ultraviolet light to the recording medium, and a first cover body configured to cover the discharge port in a freely openable and closeable manner, wherein the first cover body is opened upon discharging the recording medium via the discharge port.

According to one feature, at least a lower portion of the first cover body is soft material. Additionally, the first cover body is opened by being pushed from the rear by the recording medium. Furthermore, a lower end of the first body is disposed below a support member.

According to another feature, a support member is formed from a transfer member that supports and transfers the recording medium in a front-rear direction, and a lower edge of the discharge port is located below a portion of the transfer member that supports the recording medium.

According to yet another feature, a passing aperture located within the apparatus casing between the ultraviolet light irradiation device and the discharge port for passing the recording medium, and a second cover body rotatable with an upper portion that covers at least a portion of the passing aperture in a freely openable and closeable manner, wherein when the recording medium passes through the passing aperture, the second cover body is opened while maintaining a state in which a lower portion of the second cover body is in contact with an upper surface of the recording medium. Additionally, a lower portion of the first cover body extends lower than a lower edge of the discharge port and overlaps an exterior surface of the apparatus casing, and the lower portion of the second cover body is positioned above a lower edge of the passing aperture.

According to still yet another feature a support member is formed from a transfer member that supports and transfers the recording medium in a front-rear direction, and a front end of the transfer member is located in front of a rear end of the discharge port. Furthermore, the ink jet recording apparatus also includes a passage that is located within the apparatus casing between the ultraviolet light irradiation device and the discharge port for passing the recording medium, wherein the passage has a pair of plate-like members that are disposed up and down opposite to each other at a predetermined gap.

In accordance with another embodiment an ink jet recording apparatus is presented. The ink jet recording apparatus includes an apparatus casing comprising a discharge port that opens in a forward direction, a support member disposed within the apparatus casing in the rear of the discharge port and configured to support a recording medium, an ink head disposed within the apparatus casing and configured to eject ink curable upon irradiation of ultraviolet light to the recording medium, an ultraviolet light irradiation device disposed within the apparatus casing and configured to irradiates ultraviolet light to the recording medium, and a first cover body that covers the discharge port such that the first cover body is freely opened and closed by rotating with an upper portion of the first cover body as a pivot, wherein when the recording medium is discharged through the discharge port, the first cover body is opened while maintaining a state in which a lower portion of the cover body contacts an upper surface of the recording medium.

In accordance with yet another embodiment an ink jet recording apparatus is presented. The ink jet recording apparatus includes an apparatus casing comprising a discharge port that opens in a forward direction, a support member disposed within the apparatus casing in the rear of the discharge port and configured to support a recording medium, an ink head disposed within the apparatus casing and configured to eject ink curable upon irradiation of ultraviolet light to the recording medium, an ultraviolet light irradiation device disposed within the apparatus casing in a freely moveable manner in a left-right direction and configured to irradiate ultraviolet light to the recording medium, a transfer device configured to transfer the recording medium in a front-rear direction, and a first cover body attached to the apparatus casing and configured to cover the discharge port such that the first cover body is freely opened and closed by rotating with an upper portion of the first cover body as a pivot, wherein when the recording medium is discharged via the discharge port, the first cover body is opened while maintaining a state in which a lower portion of the cover body contacts an upper surface of the recording medium, and wherein the transfer device transfers the recording medium in the front-rear direction when the ultraviolet light irradiation device is positioned to the left or to the right of the discharge port.

BRIEF DESCRIPTION OF THE DRAWINGS

The above and other aspects, features, and advantages of the present invention will become more apparent upon consideration of the following description of preferred embodiments, taken in conjunction with the accompanying drawing figures.

DETAILED DESCRIPTION OF THE PREFERRED EMBODIMENTS

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

An embodiment of the invention will be described below with reference to the accompanying drawings. Here, as an example of an ink jet recording apparatus, an ink jet printer 1 that is used for printing on a recording media such as a glass plate G, a recording paper P, and the like will be described.

It is noted that the "recording medium" according to the invention not only includes a soft recording medium made of paper, but also includes a hard recording medium, such as, resin material such as PVC, polyester and the like, metal such as aluminum, iron, and the like, wood, glass substrate, cardboard, and the like, and other recording media composed of various kinds of material. Also, the "ink jet method" according to the invention refers to a printing method via ink jet technology. Furthermore, the "ink jet method" includes a variety of known methods, for example, various types of continuous methods such as a binary valued deflection method or a continuous deflection method, and various types of on-demand methods such as a thermal method or a piezoelectric element method.

Figure 1:
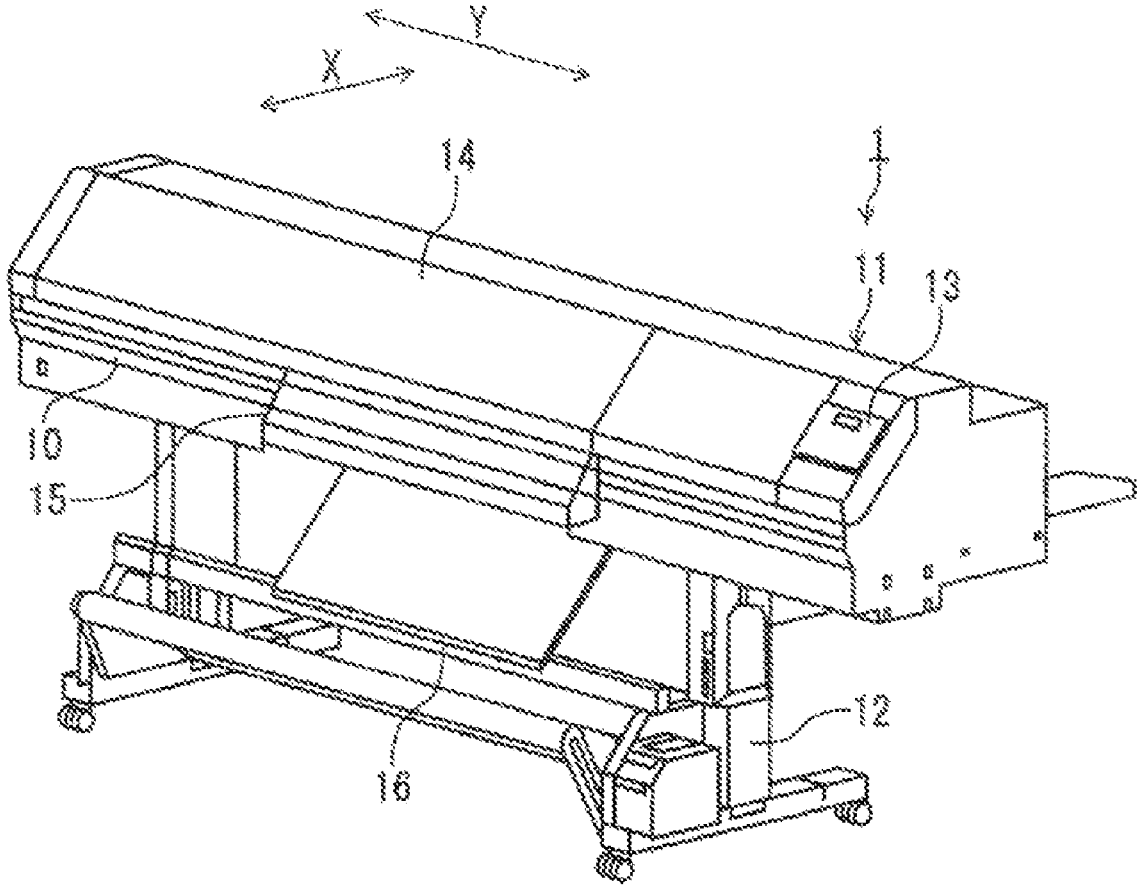
FIG. 1 illustrates an ink jet printer in accordance with an embodiment of the present invention.
Figure 2:
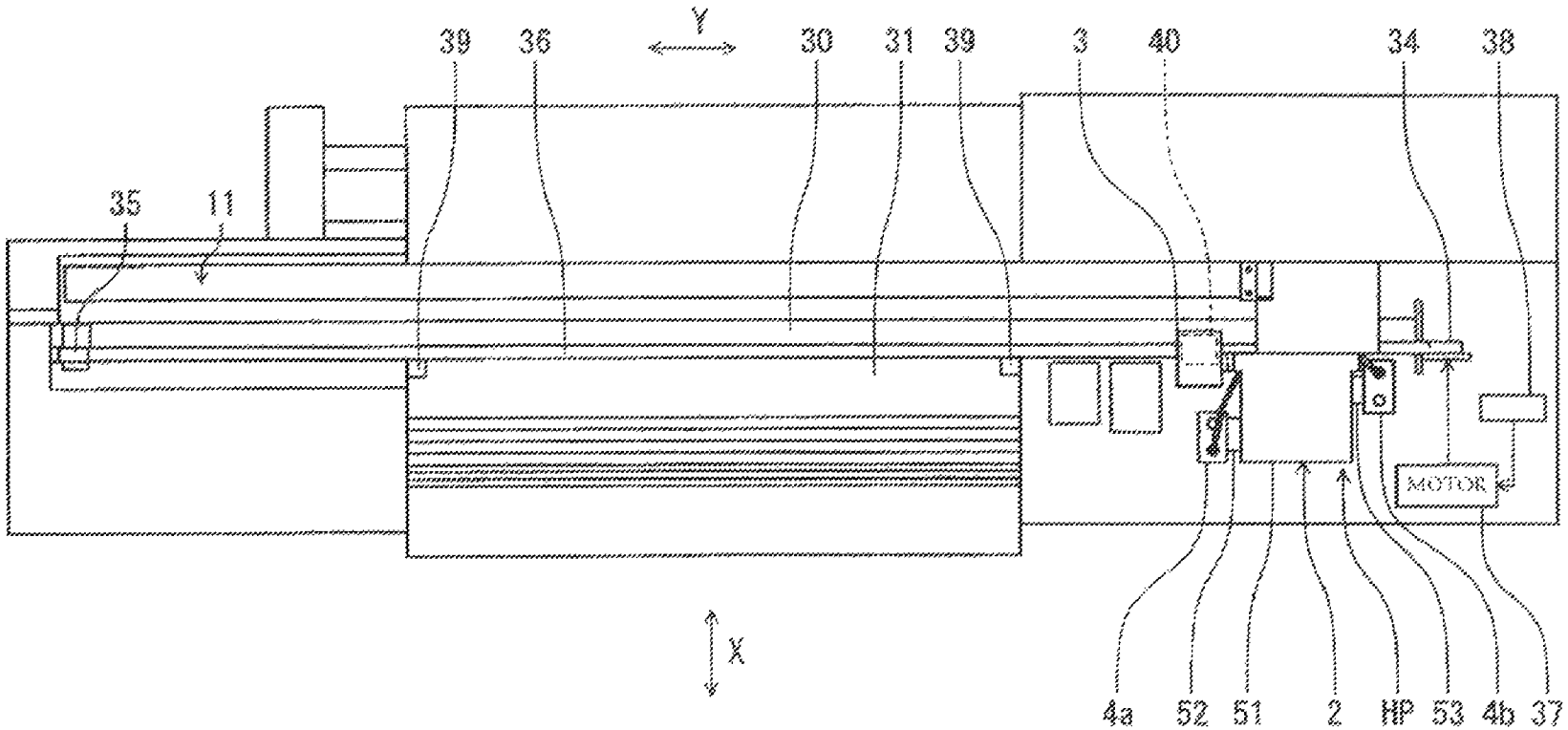
FIG. 2 is a plan view illustrating the internal structure of the ink jet printer illustrated in FIG. 1.

As illustrated in FIG. 2, the ink jet printer 1 of FIG. 1 may be equipped with an ink head 2, a cutting head 3 and a pair of ultraviolet light irradiation devices 4*a* and 4*b*. Ultraviolet light curable ink is ejected from the ink head 2 onto a recording medium at the time of printing, and the ultraviolet light curable ink is cured by irradiation of ultraviolet light by the ultraviolet light irradiation devices 4*a* and 4*b*. After printing, the cutting head 3 performs a cutting process if necessary. It is noted that Y shown in FIG. 1 indicates a primary scanning direction, and X indicates an auxiliary scanning direction that is a direction orthogonal to the primary scanning direction Y.

The ink jet printer 1 is equipped with an apparatus main body 11 having a casing 10 that extends in the primary scanning direction Y, and legs 12 that support the apparatus main body 11. An operation panel 13 is provided on the right side of the main body 11. A front cover 14 that is freely opened and closed is attached to an upper side portion of the apparatus main body 11. The apparatus main body 11 and the front cover 14 form an apparatus casing.

Figure 3:
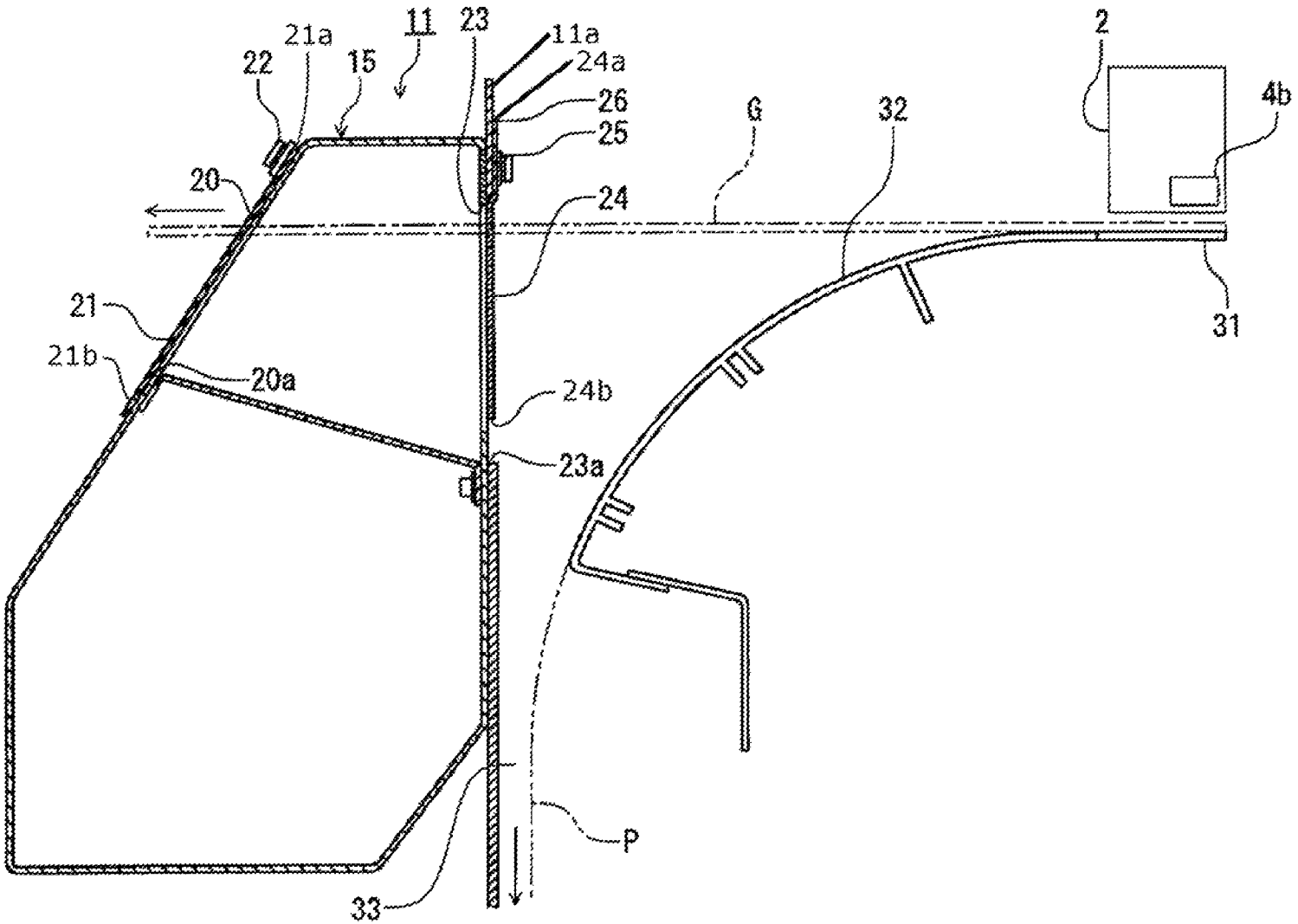
FIG. 3 is a cross-sectional view illustrating a recording medium discharge path.

The apparatus main body 11 is equipped with a box-shaped front member 15 having a discharge port 20 on its front face, as shown in FIG. 3. The discharge port 20 is closed entirely by a cover body 21 that opens and closes with its upper side as a pivot. An upper end section 21*a* of the cover body 21 is fixed to the front face of the front member 15 by a fixing device 22. A lower end section 21*b* of the cover body 21 extends further down beyond a lower edge 20*a* of the discharge port 20, and overlaps the exterior surface of the front member 15.

A vertical plate 11*a* is disposed between the discharge port 20 and the ultraviolet light irradiation devices 4*a* and 4*b*. A passing aperture 23 is formed in the vertical plate 11*a* at a position opposite to the discharge port 20. Another cover body 24 is attached to the passing aperture 23 in a manner to be freely opened and closed. An upper end section 24*a* of the cover body 24 is affixed to the vertical plate 11*a* with a guide segment 26 by a fixing device 25. The length of the cover body 24 is made shorter in its up-down direction so that the lower side section of the passing aperture 23 is normally opened. A lower end section 24*b* of the cover body 24 is located above a lower edge 23*a* of the passing aperture 23.

Each of the cover bodies 21 and 24 is made of soft rubber through which ultraviolet light does not pass. The lower end section of the guide segment 26 is bent in a manner to be inclined in a forwardly downward direction toward its tip end. It is noted that the discharge port 20 and the passing aperture 23 are arranged in front of a platen 31 to be described below. The discharge port 20 and the passing aperture 23 are positioned on a virtual plane defined by extending a plane section of the platen 31 to the frontward direction. Also, the lower end sections 21*b* and 24*b* of the cover bodies 21 and 24 are disposed below the platen 31.

As shown in FIG. 2, a guide rail 30 extending in the primary scanning direction Y is provided inside the apparatus main body 11. It is noted that, as shown in FIG. 1, the primary scanning direction Y corresponds to the left-right direction, and the auxiliary scanning direction X corresponds to the front-rear direction. In this respect, the primary scanning direction Y may be referred to as the left-right direction, and the auxiliary scanning direction X may be referred to as the front-rear direction.

The platen 31 is disposed in a central area and in front of the guide rail 30. The platen 31 is a portion for supporting the recording media at the time of printing by the ink head 2, at the time of irradiating ultraviolet light by the ultraviolet light irradiation devices 4*a* and 4*b*, and at the time of cutting the recording medium by the cutting head 3. Printing and similar operations on the recording medium are conducted on the platen 31. A guide plate 32 having a cross section in a generally arc shape is attached to the front end section of the platen 31 for guiding a recording paper P as the recording medium in a forwardly diagonally downward direction, as shown in FIG. 3. The recording paper P is discharged outside through a transfer path 33 formed in the rear of the vertical plate 11*a* and the guide 16 (see FIG. 1) for guiding the recording paper P in a forwardly, diagonally downward direction.

A pulley 34 is provided adjacent to the right end section of the guide rail 30, and a pulley 35 is provided adjacent to the left end section of the guide rail 30. An endless belt 36 is wound around the pulleys 34 and 35. A motor 37 is coupled to the pulley 34. When the motor 37 drives the pulley 34, the belt 36 is driven between the pulleys 34 and 35. A control device 38 is communicatably connected to the motor 37. The motor 37 is a motor that can be freely rotated in forward and reverse directions. The control device 38 controls the motor 37, thereby controlling movements of a carriage 40 to be described below. It is noted that, in accordance with the present embodiment, the pulley 34 is driven. Alternatively, pulley 35 may also be driven.

Figure 4:
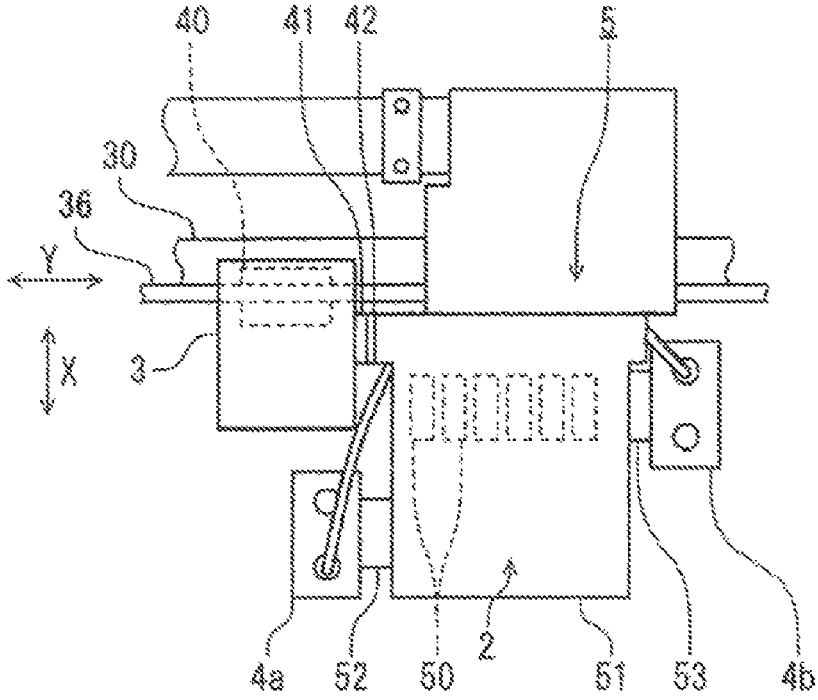
FIG. 4 is a plan view illustrating an ink head and a cutting head.

A carriage 40 built in the cutting head 3 is attached to the belt 36. The carriage 40 engages with the guide rail 30. For this reason, the cutting head 3 moves through the carriage 40 in the left-right direction as the belt 36 is driven. As shown in FIG. 4, a magnet 41 is attached to the right side section of the cutting head 3. In accordance with the present embodiment, the magnet 41 is disposed generally in the central portion of the cutting head 3 in the front-rear direction.

As shown in FIG. 2, a pair of upper and lower rollers 39 is provided at each of the left end section and the right end section of the platen 31 for feeding the recording medium in the auxiliary scanning direction X (it is noted that FIG. 2 illustrates only the upper sides of the rollers 39). Among the pair of upper and lower rollers 39, one of the rollers 39 is a driving roller that rotates itself, and the other of the rollers 39 is a pinching roller for pinching the recording medium with the driving roller. It is noted that the operation of the driving rollers is controlled by the control device 38. These rollers 39 form a transfer mechanism that transfers the recording medium in the auxiliary scanning direction X. It is noted that the set positions of the pair of upper and lower rollers 39 may not be particularly limited to the left end section and the right end section of the platen 31.

The ink head 2 is a head that ejects ink toward the recording medium. As shown in FIG. 4, the ink head 2 has a plurality of print heads 50 each having nozzles (not shown) for ejecting ink, and a print head carriage 51 that supports the print heads 50. The print head carriage 51 engages with the guide rail 30 in a manner freely moveable in the left-right direction. The print heads 50 eject ink droplets downward from the nozzles. An ink cartridge filled with ink is attached to the rear portion of the apparatus main body 11, although its illustration is omitted. The print heads 50 are connected to the ink cartridge through tubes (not shown) or the like Ink is supplied to the print heads 50 from the ink cartridge described above. It is noted that the ejection operation of the ink head 2 is also controlled by the control device 38.

The ink ejected from the nozzles of the ink head 2 is ultraviolet light curable ink. The ultraviolet light irradiation devices 4*a* and 4*b* are disposed on the right and left sides of the ink head 2. The ultraviolet light irradiation devices 4*a* and 4*b* are formed from ultraviolet light emitting diodes. It is noted that the ultraviolet light irradiation devices 4*a* and 4*b* may be formed from, for example, halogen lamps or the like. One of the ultraviolet light irradiation devices 4*a* is attached to the left side section of the print head carriage 51 through a coupling member 52. The other ultraviolet light irradiation device 4*b* is attached to the right side section of the print head carriage 51 through a coupling member 53. The ultraviolet light irradiation device 4*a* and the other ultraviolet light irradiation device 4*b* are disposed at positions mutually shifted in the front-rear direction. The ultraviolet light irradiation device 4*a* is disposed to the front of the other ultraviolet light irradiation device 4*b*. A magnet 42 is attached to the left side section of the print head carriage 51 at its rear side.

Figure 5:
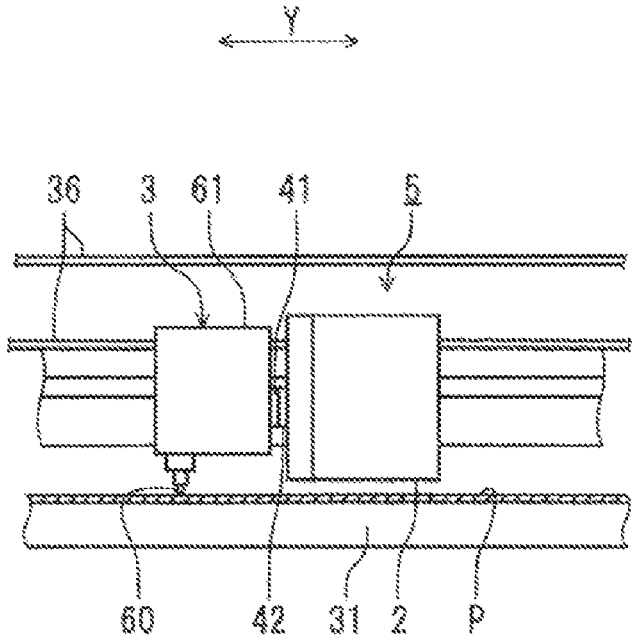
FIG. 5 is a front view illustrating a state in which a recording medium is cut by the cutting head.

The cutting head 3 is a head for cutting a recording medium such as the recording paper P. At the time of cutting the recording paper P, the cutting head 3 is moved in the primary scanning direction Y by the carriage 40, and the recording paper P is moved in the auxiliary scanning direction X by the rollers 39. As a result, the cutting head 3 can be moved two-dimensionally with respect to the recording paper P, whereby a designated portion of the recording paper P can be cut or cut out. As shown in FIG. 5, the cutting head 3 is equipped with a cutter 60 and a case 61 that supports the cutter 60 and contains therein the carriage 40. It is noted that illustration of the ultraviolet light irradiation devices 4*a* and 4*b* is omitted in FIG. 5.

The magnets 41 and 42 are attracted to each other, whereby the cutting head 3 and the ink head 2 are coupled to each other, as shown in FIG. 4 and FIG. 5. Accordingly, a head 5 with the ink head 2, the cutting head 3 and the ultraviolet light irradiation devices 4*a* and 4*b* connected in one piece is formed. On the other hand, when the belt 36 is driven in a state in which the ink head 2 is fixed so as to be immovable, and a leftward force is applied to the cutting head 3 through the carriage 40, the two magnets 41 and 42 are separated from each other. In other words, when the cutting head 3 moves to the left while the ink head 2 is fixed at a home position HP to be described below (see FIG. 2), the connection between the cutting head 3 and the ink head 2 is released. In this manner, the magnets 41 and 42 have a function of freely detachably connecting the cutting head 3 and the ink head 2.

An operation of printing on a glass plate G as a recording medium using the ink jet printer 1 will be described. The ink jet printer 1 executes printing by the ink head 2, curing ink by the ultraviolet light irradiation devices 4*a* and 4*b*, and transferring the recording medium to discharge to outside.

Figure 6:
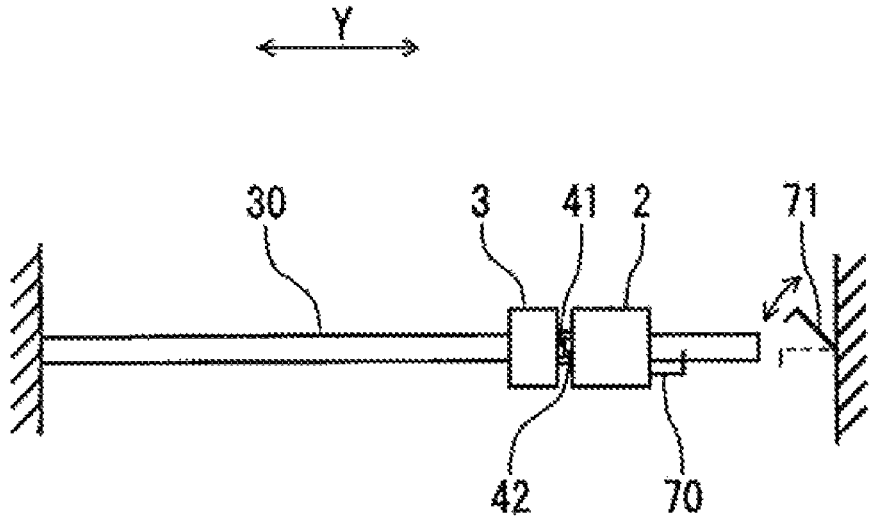
FIG. 6 is a front view for describing a coupling operation of a carriage.

At the time of printing, the ink head 2 is coupled to the cutting head 3. The two elements are connected at the home position HP of the ink head 2. As the cutting head 3 moves to the right along the guide rail 30 while the ink head 2 stands by at the home position HP, the magnet 41 on the cutting head 3 eventually contacts the magnet 42 on the ink head 2, and the cutting head 3 and the ink head 2 are coupled by the magnets 41 and 42. It is noted that, as shown in FIG. 6, an engaging member 70 is provided on the ink head 2, and an engaging member 71, which can engage with and disengage from the engaging member 70 of the ink head 2, is provided at the right end section of the apparatus main body 1. At the end of a cut-out processing, the engaging member 71 is moved from an engaged state, such as a state indicated by a dotted line in FIG. 6, to a disengaged state such as, a state indicated by a solid line in FIG. 6, whereby the engagement between the engaging member 70 on the ink head 2 and the engaging member 71 on the apparatus main body 11 is released. Therefore, as the cutting head 3 moves in the primary scanning direction Y, the ink head 2 moves together with the cutting head 3 in the primary scanning direction Y.

The ink head 2 ejects ink droplets toward the glass plate G while reciprocally moving in the primary scanning direction Y. The glass plate G is transferred in the auxiliary scanning direction X by the rollers 39, with the reciprocal movements of the ink head 2. For example, as the ink head 2 is moved from a first side to a second side in the primary scanning direction Y, the glass plate G is transferred forward by a predetermined length; as the ink head 2 is reversed and moved from the second side to the first side, the glass plate G is again transferred forward by a predetermined length, and thereafter similar operations are repeated. Accordingly, a two-dimensional image or the like is formed on the glass plate G. Also, the ultraviolet light irradiation devices 4*a* and 4*b* are operated with the movements of the ink head 2 in the primary scanning direction Y and, thereby, ultraviolet light is irradiated on the ink droplets discharged on the glass plate G. Thereafter, the ink droplets on the glass plate G are cured and dried, and fixed on the glass plate G.

As illustrated in FIG. 3, the glass plate G transferred by the rollers 39 in the auxiliary scanning direction X linearly advances on the platen 31. The front end section of the glass plate G comes in contact with the cover body 24 provided at the passing aperture 23. As the glass plate G is being transferred with a predetermined feeding force by the rollers 39, the rubber cover body 24 is flexed forward upon receiving the pushing force of the glass plate G. Although not shown, in this example, the lower portion 24*b* of the cover body 24 assumes a state of being in contact with the upper surface of the glass plate G. Accordingly, any gap between the glass plate G and the upper end of the passing aperture 23 is closed by the cover body 24. The glass plate G is transferred, passing through the passing aperture 23, to the front member 15.

Figure 7:
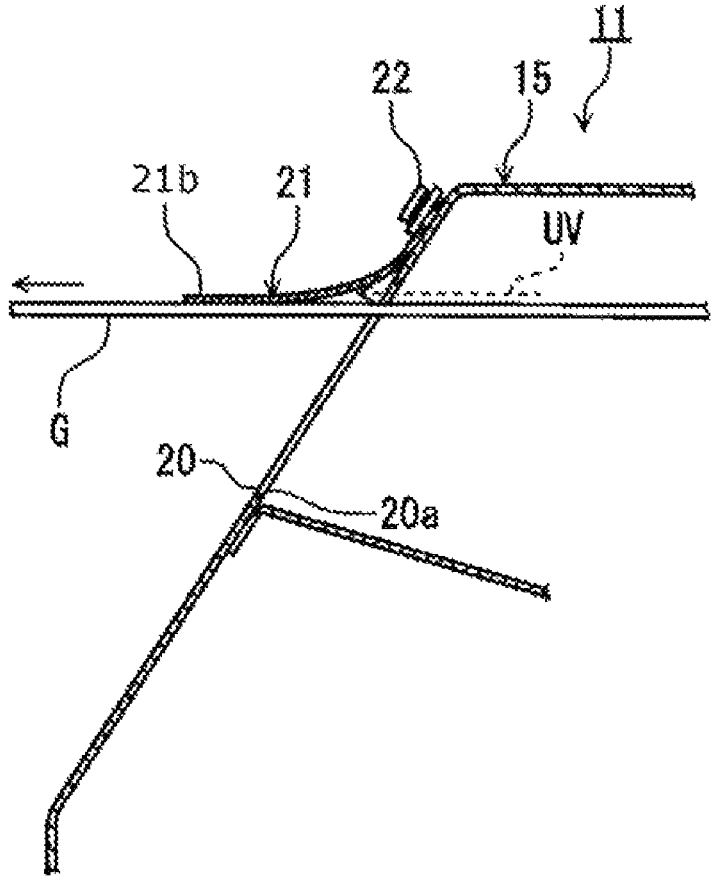
FIG. 7 is a cross-sectional view of a cover body and other elements at the time of discharging the recording medium.

Thereafter, the front end section of the glass plate G comes in contact with the cover body 21 provided at the discharge port 20. Additionally, the cover body 21 is flexed forward upon receiving the pushing force of the glass plate G, and the discharge port 20 is opened. As shown in FIG. 7, the lower end section 21*b* of the cover body 21 also assumes a state of being in contact with the upper surface of the glass plate G. Accordingly, any gap between the glass plate G and the upper end of the discharge port 20 is closed by the cover body 21. Therefore, ultraviolet light UV that is irradiated on the upper surface of the glass plate G from the ultraviolet light irradiating devices 4*a* and 4*b* and then advances along the horizontal direction is blocked by the cover body 21. Thus, the glass plate G is discharged outside through the discharge port 20 without the ultraviolet light UV leaking outside.

When the recording medium is composed of a soft material such as the recording paper P or the like, the ink jet printer 1 can execute printing by the ink head 2, curing and drying ink by the ultraviolet light irradiation devices 4*a* and 4*b*, cutting out by the cutting head 3, and transferring the recording medium to be discharged outside. As the printing by the ink head 2 and the curing and drying of ink by the ultraviolet light irradiation devices 4*a* and 4*b* are performed in a manner similar to the case of the glass plate G described above, their description is omitted. Hereafter, the cutting-out operation by the cutting head 3 and transfer operation to discharge the recording medium to the outside are described.

At the time of the cutting-out operation, the ink head 2 waits at the home position HP in a state being separated from the cutting head 3 (see FIG. 2). At the time of completion of printing, the ink head 2 is transferred to the home position HP by the cutting head 3. When the ink head 2 reaches the home position HP, the engagement member 71 (see FIG. 6) assumes the engaged stated from the disengaged state, and engages with the engagement member 70 on the ink head 2. As the cutting head 3 moves to the left in this state, the cutting head 3 is separated from the ink head 2 against the attractive force between the magnet 41 on the cutting head 3 and the magnet 42 on the ink head 2. Thus, the ink head 2 remains at the home position HP and stands by at the home position HP. It is noted that, in FIG. 6, illustration of the belt 36 and the ultraviolet light irradiation devices 4*a* and 4*b* are omitted.

When the cutting head 3 moves to a predetermined position above the recording paper P, a cutter 60 of the cutting head 3 (see FIG. 5) is lowered, thereby cutting into the recording paper P. While keeping the state in which the cutter 60 cuts in the recording paper P, the cutting head 3 moves in the primary scanning direction Y, and the recording paper P is transferred by the rollers 39 in the auxiliary scanning direction X. Accordingly, the recording paper P is cut out in a predetermined shape.

The recording paper P transferred further by the rollers 39 in the auxiliary scanning direction X moves down along the guide plate 32, as shown in FIG. 3, and is discharged onto the guide 16 through the transfer path 33.

As described above, in the ink jet printer 1 in accordance with the present embodiment, the discharge port 20 and the passing aperture 23 are disposed at the front of the platen 31. For this reason, the rigid glass plate G transferred forward from the platen 31 can be readily discharged outside through the discharge port 20 and the passing aperture 23.

Furthermore, the cover bodies 21 and 24 made of rubber that does not transmit ultraviolet light are attached at the discharge port 20 and the passing aperture 23 in a manner to be opened and closed with their upper sides as pivots. The lower end sections 21*b* and 24*b* of the cover bodies 21 and 24 are arranged below the platen 31. When the glass plate G is discharged, the lower end sections 21*b* and 24*b* of the cover bodies 21 and 24 are brought in contact with the glass plate G, thereby blocking ultraviolet (UV) light that may leak out from the upper area of the glass plate G to the front. For this reason, ultraviolet light irradiated from the ultraviolet light irradiation devices 4*a* and 4*b* can be securely prevented from leaking outside the apparatus.

As each of the cover bodies 21 and 24 is composed of soft material, such as rubber, contact thereof with a printing surface (the upper surface) of the glass plate G would not damage the printing surface, such that the printing condition can be well maintained. It is noted that "soft material" refers to any material that is soft to the extent so as not to damage a printing surface of a recoding medium. For example, "soft material" is a material softer than a recording medium composed of a hard material.

Furthermore, in accordance with the present embodiment, because each of the rubber cover bodies 21 and 24 is opened and closed by the glass plate G that is transferred, it is not necessary to provide an additional driving device for opening and closing the cover bodies 21 and 24. In other words, by effectively using the characteristic of a hard recording medium, a driving device for opening and closing the cover bodies 21 and 24 can be omitted. Accordingly, the overall structure of the apparatus can be simplified, and therefore its manufacturing can be readily conducted at low cost. It is noted however that it is possible to provide an independent open-close device such as an actuator for opening and closing the cover bodies 21 and 24. Such an open-close device may be provided depending on the necessity.

In accordance with the present embodiment, leakage of ultraviolet light to the outside can be prevented at two stages by the two cover bodies 21 and 24. Accordingly, external leakage of ultraviolet light can be more securely prevented. However, the cover body 24 may possibly be omitted.

The lower end section 21*b* of the cover body 21 extends lower than the lower edge 20*a* of the discharge port 20, and overlaps the external surface of the front member 15. Therefore, leakage of ultraviolet light through the discharge port 20 can be more securely prevented. On the other hand, the cover body 24 disposed inside the apparatus main body 11 has the lower end section 24*b* that is located above the lower edge 23*a* of the passing aperture 23. In other words, the length of the cover body 24 in the up-down direction is formed shorter so that the lower portion of the passing aperture 23 is opened. For this reason, when the cover body 24 is opened, the amount of its protrusion in the frontward direction is reduced. Thus, unwanted contact of the cover body 24 with other constituent members can be appropriately avoided. However, it is also possible to cover the passing aperture 23 entirely by the cover body 24.

As described above, the ultraviolet light irradiation devices 4*a* and 4*b* irradiate ultraviolet light while reciprocally moving in the primary scanning direction Y. It is noted that, when the ultraviolet light irradiation devices 4*a* and 4*b* are located to the left or to the right of the discharge port 20, the possibility of external leakage of ultraviolet light through the discharge port 20 is much lower. In this way, when the ultraviolet light irradiation devices 4*a* and 4*b* are moved to the left or to the right of the discharge port 20, the recording medium may be transferred in the front-rear direction by the rollers 39. When the recording medium is transferred in the front-rear direction, the recording medium slidably moves against the cover body 24, and there is a possibility that the cover body 24 may slightly and momentarily open. However, if the ultraviolet light irradiation devices 4*a* and 4*b* are positioned away from the discharge port 20 to the left side or to the right side thereof, ultraviolet light would not leak outside through the discharge port 20, even when the cover body 24 momentarily and slightly opens. Therefore, when the ultraviolet light irradiation devices 4*a* and 4*b* are moved to the left or to the right of the discharge port 20, as viewed from the front side, the recording medium may be transferred in the front-rear direction, whereby leakage of ultraviolet light can be more securely prevented.

Figure 8:
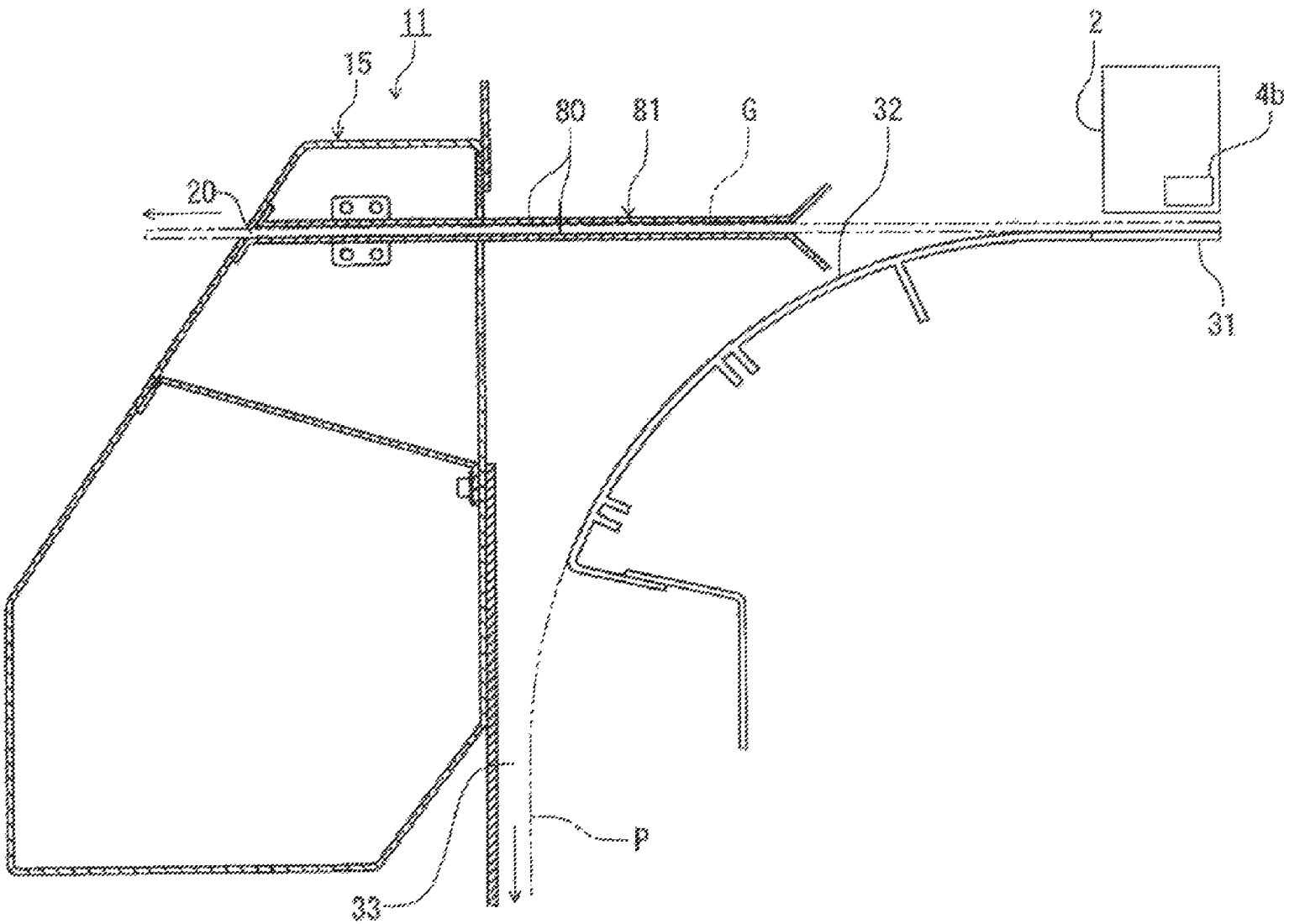
FIG. 8 is a cross-sectional view illustrating a recording medium discharge path in accordance with another embodiment of the present invention.

In the first embodiment, the cover bodies 21 and 24 are provided at the discharge port 20 and the passing aperture 23 in a manner freely opened and closed. Instead, the following structure is possible. Specifically, as shown in FIG. 8, a pair of plate-like members 80 are arranged up and down, opposite to each other at a predetermined gap, thereby forming a passage 81 through which a glass plate G can be passed. The passage 81 is disposed between the front of the platen 31 and the discharge port 20. Accordingly, the glass plate G having been printed is transferred in the auxiliary scanning direction X within the passage 81, and discharged outside through the discharge port 20.

In this case, by providing the passage 81 with a sufficient length in the front-rear direction, and forming the gap of the plate-like members 80 narrower, external leakage of ultraviolet light can be appropriately prevented. This also provides an advantage in that the entire body can be readily structured. In this manner, external leakage of ultraviolet light can be suppressed even when the cover bodies are omitted.

When the recording medium is made of somewhat deformable material such as a cardboard or the like, the passage 81 may be formed in a slightly curved shape. By curving the passage 81 in this manner, external leakage of ultraviolet light can be further suppressed.

In the second embodiment, the passage 81 may possibly be omitted. Even in such a case, as the discharge port 20 is a small opening, external leakage of ultraviolet light can be suppressed better compared to the structure in which the frontal area of the platen 31 is widely opened.

In the first and second embodiments, a supporting member to support a recording medium is the platen 31, and a transfer device for transferring a recording medium is the pair of upper and lower rollers 39. According to the embodiments described above, the recording medium is transferred by rotating the rollers 39, while the recording medium is pinched between the pair of upper and lower rollers 39. However, the supporting member and the transfer device are not limited to the embodiments described above. In accordance with the present embodiment, the supporting member and the transfer member are formed in one piece. In other words, a transfer member that transfers a recording medium in the front-rear direction while supporting the recording medium also forms the supporting member. Hereunder, portions similar to those of the first or second embodiment are appended with like reference numbers, and their description is omitted.

Figure 9:
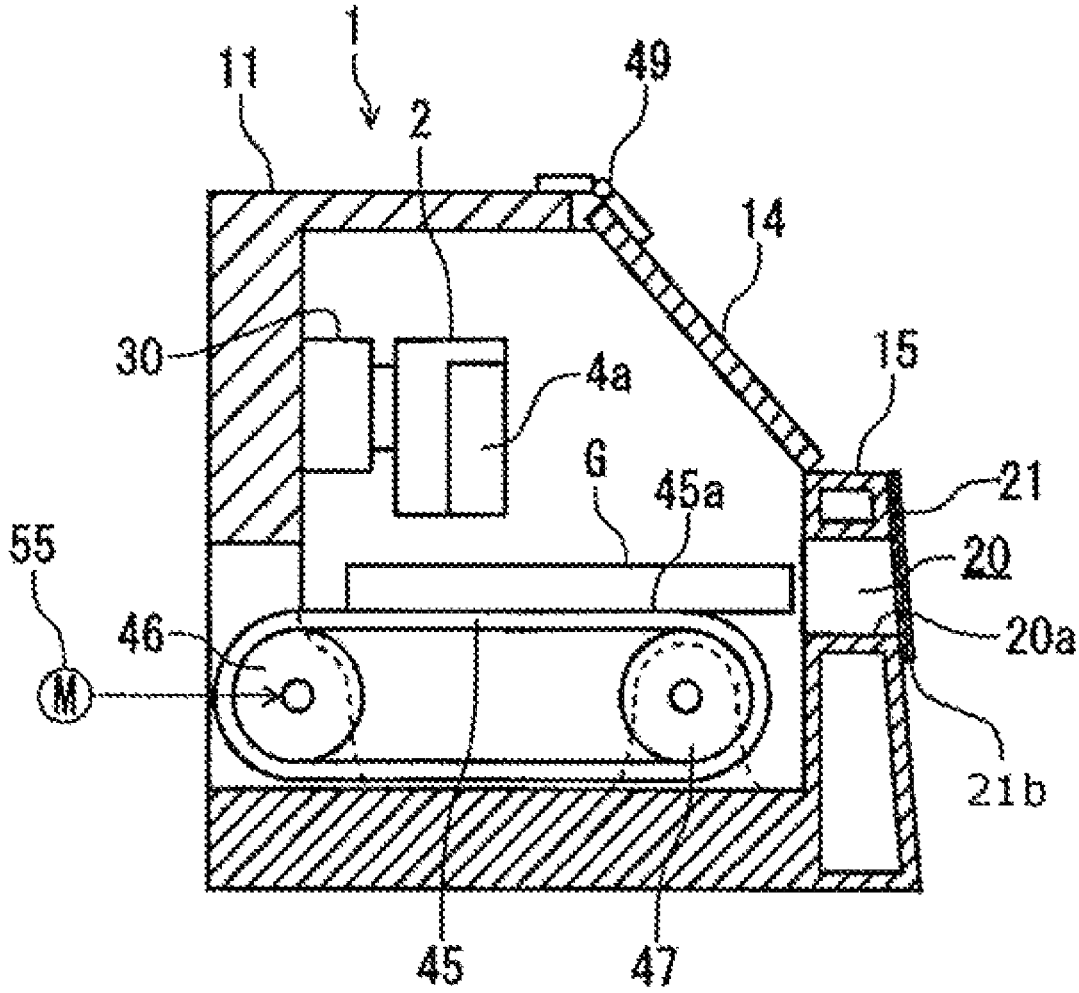
FIG. 9 is a cross-sectional view showing an ink jet printer in accordance with another embodiment of the present invention.
Figure 10:
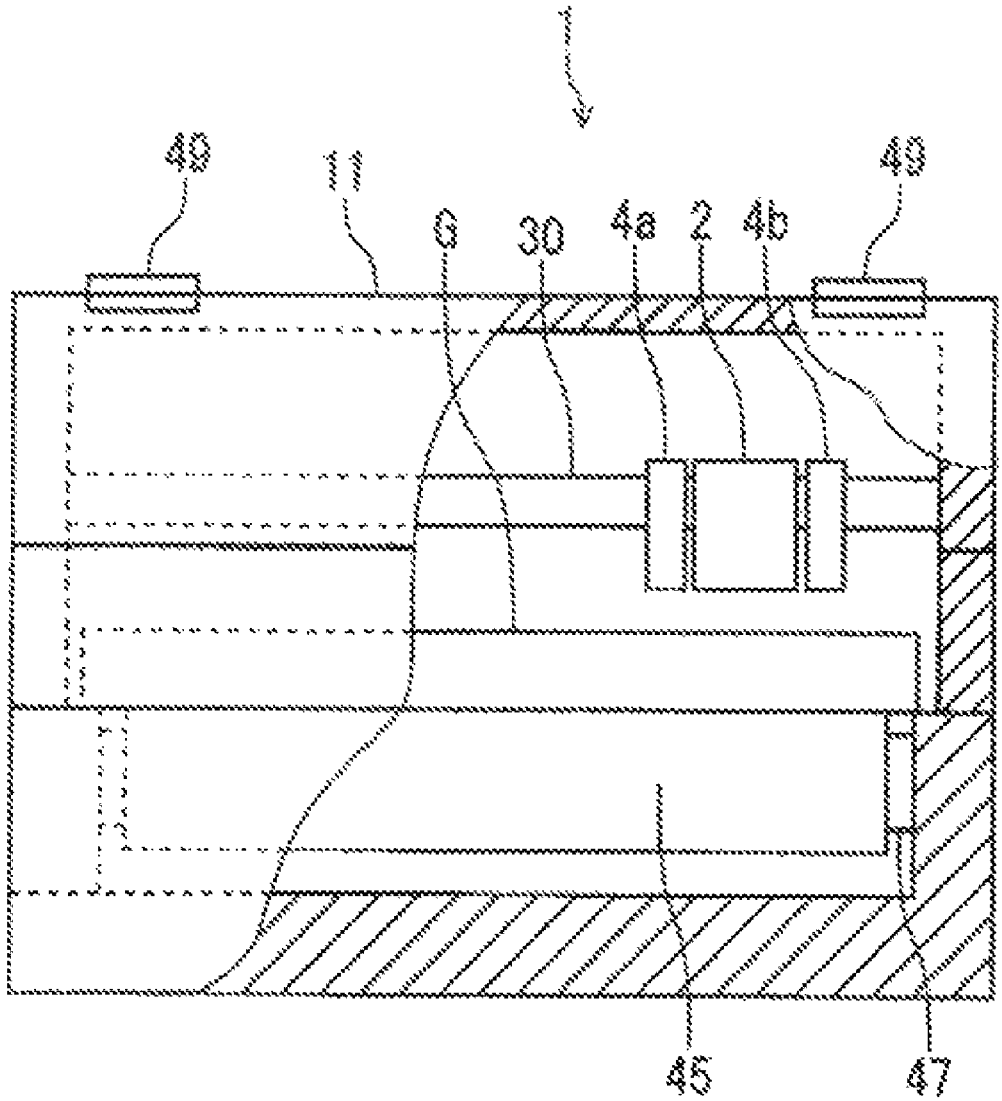
FIG. 10 is a front view of an ink jet printer in accordance with another embodiment of the present invention.

As shown in FIG. 9 and FIG. 10, an ink jet printer 1 in accordance with the present embodiment is equipped with a conveyor belt 45, instead of the platen. The conveyor belt 45 is wound around a front-side pulley 47 and a rear-side pulley 46. A motor 55 is connected to the rear-side pulley 46. However, the motor 55 may be connected to the front-side pulley 47. As the motor 55 rotates, the pulley 46 is rotated, whereby the conveyor belt 45 is driven in the front-rear direction. The motor 55 can be rotated in both directions, such that the conveyor belt 45 can transfer a recording medium such as a glass plate G or the like either in the frontward direction or in the backward direction.

The conveyor belt 45 and the pulleys 46 and 47 are not at all limited to any particular materials, structures or measurements. In accordance with the present embodiment, the conveyor belt 45 is a flat belt. However, the conveyor belt 45 may be made of a different kind of belt, such as a belt with driving teeth or V-belts. The conveyor belt 45 may be a belt made of rubber, a belt made of resin, or a belt made of metal. Further, the belt can be made of a combination of the aforementioned materials. The surface of the conveyor belt 45 may be provided with irregularities or may be flat. The pulleys 46 and 47 may be in any configuration that accommodates the conveyor belt 45. For example, when the conveyor belt 45 is composed of V-belts, the pulleys may be formed on their outer surfaces with V grooves to engage the V-belts described above. Also, when the conveyor belt 45 is formed from a belt with driving teeth, pulleys with driving teeth provided on their outer surface may be used as the pulleys 46 and 47.

Similar to the first embodiment, the apparatus main body 11 is provided with a cover body 21 that opens and closes with its upper side as a pivot. A discharge port 20 is covered by the cover body 21 in a manner to be freely opened or closed. A lower end section 21*b* of the cover body 21 extends downwardly beyond a lower edge 20*a* of the discharge port 20, and overlaps the exterior surface of the front member 15. In accordance with the present embodiment, the cover body 21 is also made of soft rubber that does not transmit ultraviolet light. However, the cover body 21 is not particularly limited to any material.

Additionally, in accordance with the present embodiment, the cover body 21 is opened when pushed by the glass plate G. When the glass plate G is discharged, the lower end section 21*b* of the cover body 21 is brought in contact with the surface of the glass plate G. Therefore, ultraviolet light can be securely prevented from leaking outside. In accordance with the present embodiment, the effects described above can be obtained by the ink jet printer 1 equipped with the conveyor belt type transfer device.

The upper surface of the conveyor belt 45 composes a supporting surface 45*a* that supports the glass plate G. The discharge port 20 is located on a virtual plane defined by extending the supporting surface 45*a* of the belt conveyor 45 to the front side. Also, the lower end sections 21*b* and 24*b* of the cover bodies 21 and 24 are disposed below the supporting surface 45*a* of the conveyor belt 45. In this manner, as the supporting surface 45*a* of the conveyor belt 45 is higher than the lower edge 20*a* of the discharge port 20, leakage of ultraviolet light can be effectively prevented by the cover body 21.

According to the conveyor belt type transfer device, a thicker recording medium or a heavier recording medium can be transferred. Therefore, according to the present embodiment, printing on a greater variety of recoding media becomes possible. It is noted that when a thicker recording medium is to be accommodated, the discharge port 20 must be made larger. Therefore ultraviolet light would likely leak without some contrivance. However, in accordance with the present embodiment, as described above, the cover body 21 prevents leakage of ultraviolet light. Therefore, there is a lower possibility of external leakage of ultraviolet light even when the discharge port 20 is enlarged.

The front cover 14 is attached to the apparatus main body 11 by a hinge 49 in a manner freely opened and closed. Other aspects are generally the same as those of the first embodiment.

Figure 11:
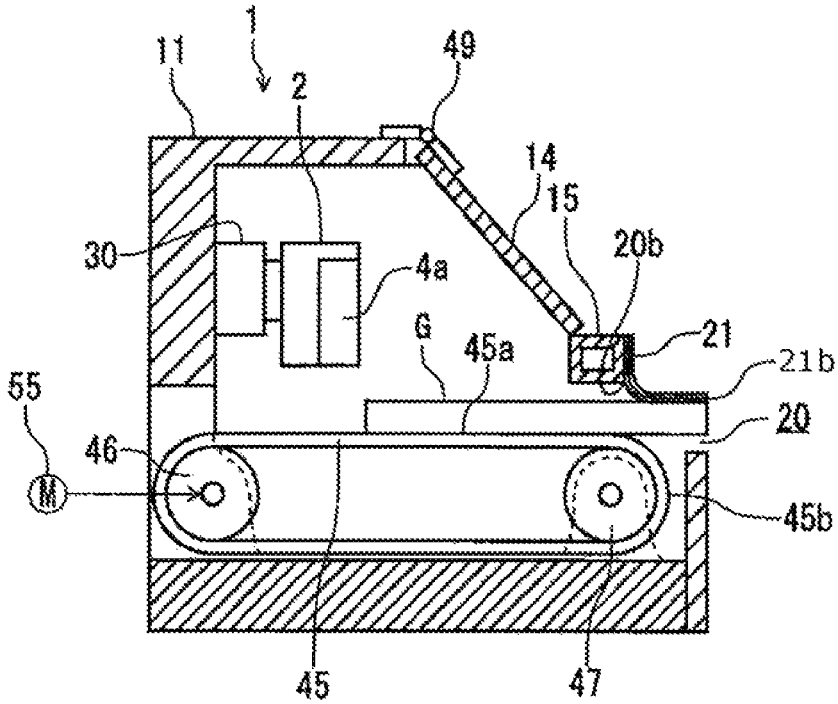
FIGS. 11 (*a*) and (*b*) are cross-sectional views of an ink jet printer in accordance with other embodiments of the present invention.
Figure 11:
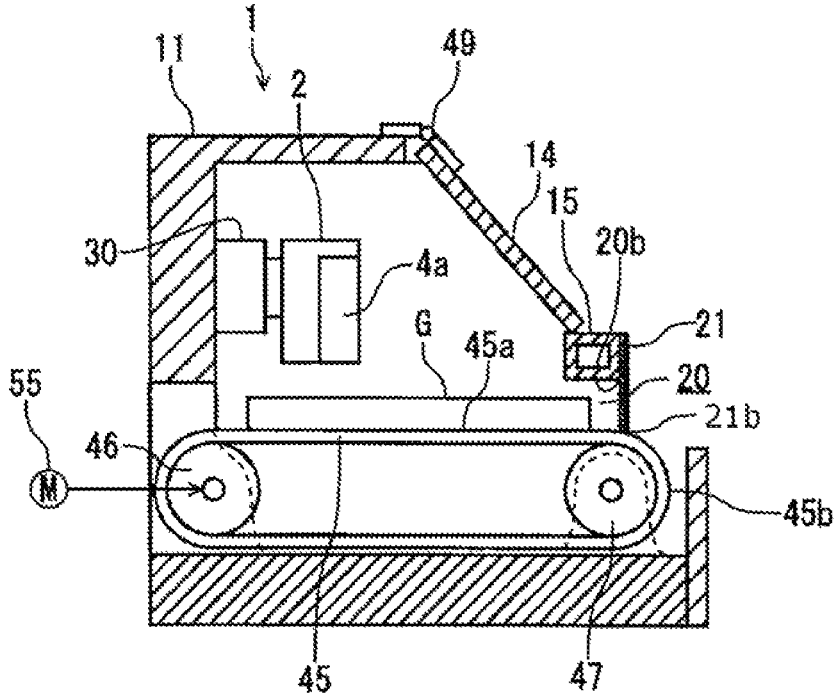

FIGS. 11 (*a*) and (*b*) are cross-sectional views of another conveyor belt type ink jet printer 1. In the ink jet printer 1, the length of a conveyor belt 45 in the front-rear direction is longer than that described in FIG. 9. In the ink jet printer 1, illustrated in FIGS. 11(*a*) and (*b*) a front end 45*b* of the conveyor belt 45 is positioned at the front of the rear end 20*b* of the discharge port 20. As shown in FIG. 11 (*b*), when the cover body 21 is not pushed by the glass plate G, the lower end section 21*b* of the cover body 21 is in contact with the supporting surface 45*a* of the conveyor belt 45. As a result, the discharge port 20 is closed by the cover body 21. On the other hand, as shown in FIG. 11 (*a*), when the cover body 21 is pushed forward by the glass plate G, the cover body 21 is deformed with its upper side section as a pivot. As a result, the discharge port 20 is opened, which allows the glass plate G to be discharged forward to the front. Other aspects are similar to those of the ink jet printer 1 shown in FIG. 9 and FIG. 10. With the ink jet printer 1 illustrated in FIGS. 11(*a*) and (*b*), a longer glass plate G can be subject to printing.

Figure 12:
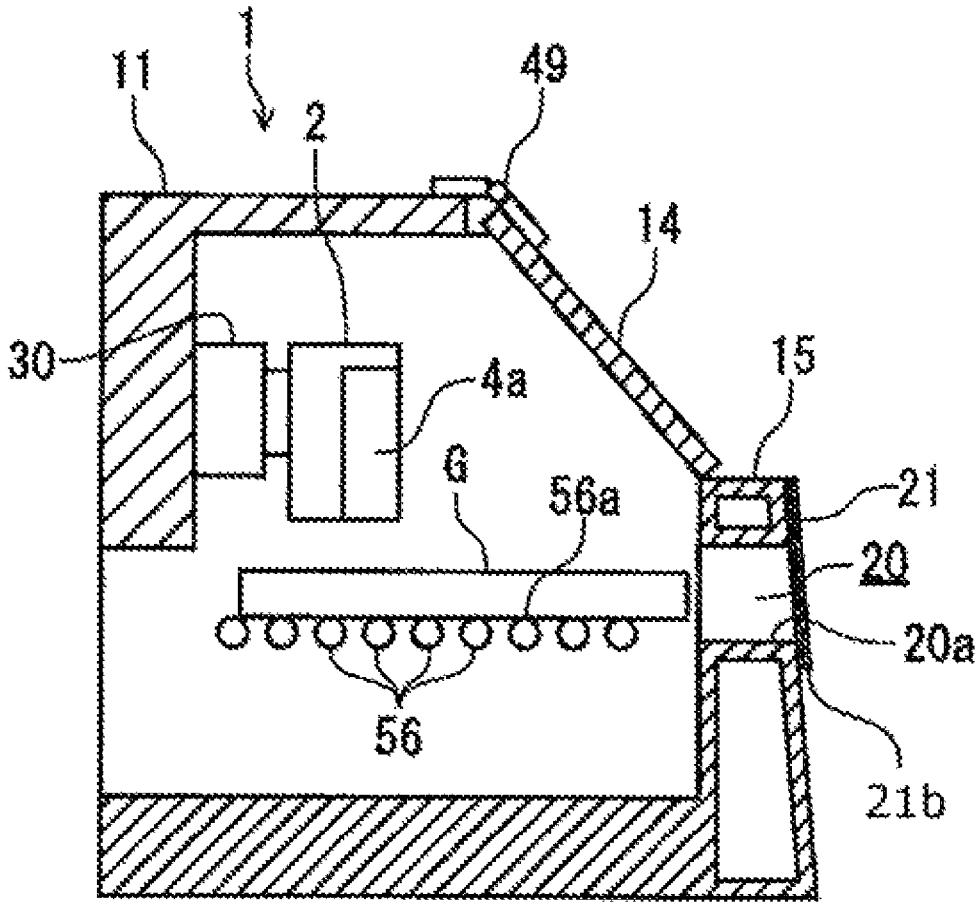
FIG. 12 is a cross-sectional view of an ink jet printer in accordance with another embodiment of the present invention.

FIG. 12 shows an apparatus equipped with a plurality of rollers 56 instead of the conveyor belt 45. The rollers 56 are structured so as to be able to transport the glass plate G in the front-rear direction while supporting the same. The type and number of the rollers 56 are not particularly limited. In accordance with the present embodiment, the rollers 56 are self-rotating rollers. However, a portion of the rollers 56 may be rollers that do not rotate by themselves. In other words, a portion of the rollers 56 may be rollers that support but do not transfer the glass plate G. Each of the rollers 56 supports the glass plate G by its upper end section. The lower edge 20*a* of the discharge port 20 is located below sections 56*a* where the rollers 56 support the glass plate G. Thus, leakage of ultraviolet light can be effectively prevented by the cover body 21.

In the ink jet printer 1 illustrated in FIG. 12, the entire length in the front-rear direction of the rollers 56 may be made longer, though such illustration is omitted. For example, in the ink jet printer 1 illustrated in FIG. 12, the number of the rollers 56 may be increased. Also, in the ink jet printer 1 illustrated in FIG. 12, the rollers 56 may be spaced at greater intervals. In this case, the front end of the roller 56 that is located at the front most position may be positioned in front of the rear end 20*b* of the discharge port 20 (see FIG. 11 (*a*)). Accordingly, in the ink jet printer 1 equipped with the plurality of rollers 56, a longer glass plate G can be subject to printing.

In accordance with the present embodiment, the time at which the glass plate G is transferred in the front-rear direction by the conveyor belt 45 or the rollers 56 is not particularly limited. In the present embodiment also, the glass plate G may be transferred in the front-rear direction when the ultraviolet light irradiation device 4*a* or 4*b* is located to the left or to the right of the discharge port 20.

The embodiments disclosed herein may be combined and implemented. For example, the first embodiment may be provided with the passage 81 of the second embodiment.

The material of the cover bodies 21 and 24 may not be limited to rubber in accordance with the embodiments described herein, and may be, for example, cloths or the like. Further, the cover bodies 21 and 24 may be formed with soft material in only portions where the recording medium, such as the glass plate G, contacts. Furthermore the cover bodies 21 and 24 may be each structured with a metal plate having a piece of rubber provided at its lower end section, and may be attached to the discharge port 20 and the passing aperture 23 through hinges or the like.

The lower end sections 21*b* and 24*b* of the cover bodies 21 and 24 are structured to rub against the recording medium. However, the lower end sections 21*b* and 24*b* of the cover bodies 21 and 24 may be acceptable as long as they are in contact with the recording medium at the time of discharging the recording medium. Therefore, for example, the cover bodies 21 and 24 may be made of metal or the like and rollers or the like that roll on the recording medium may be provided at the lower end sections 21*b* and 24*b* thereof.

Also, in accordance with the first embodiment and second embodiment described above, the lower end section 21*a* and 24*a* of each of the cover bodies 21 and 24 is disposed lower than the platen 31, but may not necessarily be structured in such a manner.

Furthermore, the embodiments described above are structured such that the glass plate G passes through the upper side portion of the cover bodies 21 and 24, but may be structured such that it passes through the lower side portion (in other words, in the lower side than the intermediate position in the up-down direction). Thus, each of the covers 21 and 24 can be opened by a relatively small pushing force, whereby such an incident as the glass plate G becoming clogged within the apparatus would become difficult to occur. Also, the amount of protrusion of the cover bodies 21 and 24 to the front side as they are opened can be reduced.

Also, the ink jet printer 1 in accordance with the embodiments described herein is structured to be used for recording media made of soft material such as the recording paper P or the like. However, it need not necessarily be structured in such a manner, and may be structured so as to be used for only recording media made of hard material such as the glass plate G or the like.

Furthermore, design changes can be freely made in the structure of each of the components, such as the configuration of the ink jet printer 1 and the like, within the intended scope of the present invention.

What is claimed is:

1. An ink jet recording apparatus comprising:

an apparatus casing comprising a discharge port which opens in a forward direction with respect to a front portion the ink jet recording apparatus;

a support member disposed within the apparatus casing and in a rear portion of the discharge port and configured to support a recording medium;

a guide plate having an arch-shaped cross-section and located at a front end section of the support member;

an ink head disposed within the apparatus casing and configured to eject ink that is curable with ultraviolet light onto the recording medium;

an ultraviolet light irradiation device disposed within the apparatus casing and configured to irradiate ultraviolet light onto the recording medium; and a first cover body configured to cover the discharge port in a freely openable manner and a freely closeable manner, wherein the first cover body is opened when the recording medium is discharged via the discharge port.

2. The ink jet recording apparatus of claim 1, wherein at least a lower portion of the first cover body is composed of a soft material.

3. The ink jet recording apparatus of claim 1, wherein the first cover body is opened by being pushed from a rear portion of the first cover body by the recording medium.

4. The ink jet recording apparatus of claim 1, wherein a lower end of the first cover body is disposed below the support member.

5. The ink jet recording apparatus of claim 1, wherein:

the support member is formed from a transfer member that supports and transfers the recording medium in a front-rear direction with respect to the front portion of the ink jet recording apparatus; and a lower edge of the discharge port is located below a portion of the support member.

6. The ink jet recording apparatus of claim 1, further comprising:

a passing aperture located within the apparatus casing and between the ultraviolet light irradiation device and the discharge port, the passing aperture configured for passing the recording medium; and a second cover body that is rotatable with an upper portion of the apparatus casing and covers at least a portion of the passing aperture in a freely openable manner and a freely closeable manner, wherein the second cover body is opened while a lower portion of the second cover body contacts an upper surface of the recording medium when the recording medium passes through the passing aperture.

7. The ink jet recording apparatus of claim 6, wherein:

a lower portion of the first cover body extends below a lower edge of the discharge port and overlaps an exterior surface of the apparatus casing; and the lower portion of the second cover body is positioned above a lower edge of the passing aperture.

8. The ink jet recording apparatus of claim 1, wherein:

the support member is formed from a transfer member that supports and transfers the recording medium in a front-rear direction with respect to the front portion of the ink jet recording apparatus; and a front end of the transfer member is located before a rear end of the discharge port.

9. An ink jet recording apparatus comprising:

an apparatus casing comprising a discharge port which opens in a forward direction with respect to a front portion of the ink jet recording apparatus;

a support member disposed within the apparatus casing and in a rear portion of the discharge port and configured to support a recording medium;

an ink head disposed within the apparatus casing and configured to eject ink that is curable with ultraviolet light onto the recording medium;

an ultraviolet light irradiation device disposed within the apparatus casing and configured to irradiate ultraviolet light onto the recording medium;

a first cover body configured to:

cover the discharge port in a freely openable manner and a freely closeable manner, and open when the recording medium is discharged via the discharge port; and a passage that is located within the apparatus casing and between the ultraviolet light irradiation device and the discharge port, the passage configured to pass the recording medium and comprising a pair of plate-like members that are disposed such that one is below the other and separated from each other by a predetermined gap.

10. An ink jet recording apparatus comprising:

an apparatus casing comprising a discharge port that opens in a forward direction with respect to a front portion of the ink jet recording apparatus;

a support member that is disposed within the apparatus casing and in a rear portion of the discharge port and configured to support a recording medium;

a guide plate having an arch-shaped cross-section and located at a front end section of the support member;

an ink head disposed within the apparatus casing and configured to eject ink that is curable with ultraviolet light onto the recording medium;

an ultraviolet light irradiation device disposed within the apparatus casing and configured to irradiate ultraviolet light onto the recording medium; and a first cover body that covers the discharge port such that the first cover body is freely opened and freely closed by a rotation using an upper portion of the first cover body as a pivot for the rotation, wherein the first cover body is opened while a lower portion of the first cover body contacts an upper surface of the recording medium when the recording medium is discharged through the discharge port.

11. The ink jet recording apparatus of claim 10, wherein at least the lower portion of the first cover body is composed of a soft material.

12. The ink jet recording apparatus of claim 10, wherein the first cover body is opened by being pushed from a rear portion of the first cover body by the recording medium.

13. The ink jet recording apparatus of claim 10, wherein a lower end of the first cover body is disposed below the support member.

14. The ink jet recording apparatus of claim 10, wherein:

the support member is formed from a transfer member that supports and transfers the recording medium in a front-rear direction with respect to the front portion of the ink jet recording apparatus; and a lower edge of the discharge port is located below a portion of the support member.

15. The ink jet recording apparatus of claim 10, further comprising:

a passing aperture located between the ultraviolet light irradiation device and the discharge port and within the apparatus casing, the passing aperture configured for passing the recording medium; and a second cover body that is rotatable with an upper portion of the apparatus casing and covers at least a portion of the passing aperture in a freely openable manner and a freely closeable manner, wherein the second cover body is opened while a lower portion of the second cover body contacts an upper surface of the recording medium when the recording medium passes through the passing aperture.

16. The ink jet recording apparatus of claim 15, wherein:

the lower portion of the first cover body extends below a lower edge of the discharge port and overlaps an exterior surface of the apparatus casing; and the lower portion of the second cover body is positioned above a lower edge of the passing aperture.

17. The ink jet recording apparatus of claim 10, wherein:

the support member is formed from a transfer member that supports and transfers the recording medium in a front-rear direction with respect to the front portion of the ink jet recording apparatus; and a front end of the transfer member is located before a rear end of the discharge port.

18. An ink jet recording apparatus comprising:

an apparatus casing comprising a discharge port that opens in a forward direction with respect to a front portion of the ink jet recording apparatus;

a support member disposed within the apparatus casing and in a rear portion of the discharge port and configured to support a recording medium;

an ink head disposed within the apparatus casing and configured to eject ink that is curable with ultraviolet light onto the recording medium;

an ultraviolet light irradiation device disposed within the apparatus casing and configured to irradiate ultraviolet light onto the recording medium;

a first cover body that covers the discharge port such that the first cover body is freely opened and freely closed by a rotation using an upper portion of the first cover body as a pivot for the rotation, wherein the first cover body is opened while a lower portion of the first cover body contacts an upper surface of the recording medium when the recording medium is discharged through the discharge port; and a passage that is located within the apparatus casing and between the ultraviolet light irradiation device and the discharge port, the passage configured to pass the recording medium and comprising a pair of plate-like members that are disposed such that one is below the other and separated from each other by a predetermined gap.

19. An ink jet recording apparatus comprising:

an apparatus casing comprising a discharge port that opens in a forward direction with respect to a front portion of the ink jet recording apparatus;

a support member disposed within the apparatus casing and in the rear of the discharge port and configured to support a recording medium;

a guide plate having an arch-shaped cross-section and located at a front end section of the support member;

an ink head disposed within the apparatus casing and configured to eject ink curable with ultraviolet light onto the recording medium;

an ultraviolet light irradiation device that is disposed within the apparatus casing, freely moveable in a left-right direction with respect to the front portion of the ink jet recording apparatus, and configured to irradiate ultraviolet light onto the recording medium;

a transfer device configured to transfer the recording medium in a front-rear direction with respect to the front portion of the ink jet recording apparatus; and a first cover body attached to the apparatus casing and configured to cover the discharge port such that the first cover body is freely opened and freely closed by a rotation using an upper portion of the first cover body as a pivot for the rotation, wherein:

the first cover body is opened while a lower portion of the first cover body contacts an upper surface of the recording medium when the recording medium is discharged via the discharge port; and the transfer device transfers the recording medium in the front-rear direction when the ultraviolet light irradiation device is positioned to a left side or a right side of the discharge port.

20. The ink jet recording apparatus of claim 19, wherein at least the lower portion of the first cover body is composed of a soft material.

21. The ink jet recording apparatus of claim 19, wherein the first cover body is opened by being pushed from a rear of the first cover body by the recording medium.

22. The ink jet recording apparatus of claim 19, wherein a lower end of the first cover body is disposed below the support member.

23. The ink jet recording apparatus of claim 19, further comprising:

a passing aperture located within the apparatus casing and between the ultraviolet light irradiation device and the discharge port, the passing aperture configured for passing the recording medium; and a second cover body that is rotatable with an upper portion of the apparatus casing that covers at least a portion of the passing aperture in a freely openable manner and a freely closeable manner, wherein the second cover body is opened while a lower portion of the second cover body contacts the upper surface of the recording medium when the recording medium passes through the passing aperture.

24. The ink jet recording apparatus of claim 23, wherein:

the lower portion of the first cover body extends below a lower edge of the discharge port and overlaps an exterior surface of the apparatus casing; and the lower portion of the second cover body is positioned above a lower edge of the passing aperture.

25. The ink jet recording apparatus of claim 23, further comprising a passage that is located within the apparatus casing and between the ultraviolet light irradiation device and the discharge port, the passage configured for passing the recording medium and comprising a pair of plate-like members that are disposed such that one is below the other and separated from each other by a predetermined gap.

26. An ink jet recording apparatus comprising:

an apparatus casing comprising a discharge port that opens in a forward direction with respect to a front portion of the ink jet recording apparatus;

a support member disposed within the apparatus casing and in the rear of the discharge port and comprising a plane section configured to support a recording medium;

an ink head disposed within the apparatus casing and configured to eject ink that is curable with ultraviolet light onto the recording medium;

an ultraviolet light irradiation device disposed within the apparatus casing and configured to irradiate ultraviolet light onto the recording medium; and a first cover body attached to the apparatus casing and configured to cover the discharge port such that the first cover body is freely opened and freely closed by a rotation using an upper portion of the first cover body as a pivot for the rotation, wherein:

the discharge port is located on a virtual plane defined by forwardly extending the plane section of the support member; and the first cover body is opened while a lower portion of the first cover body contacts an upper surface of the recording medium when the recording medium is discharged through the discharge port.

27. The ink jet recording apparatus of claim 26, wherein:

the support member is formed from a transfer member that supports and transfers the recording medium in a front-rear direction with respect to the front portion of the ink jet recording apparatus; and a lower edge of the discharge port is located below a portion of the transfer member.

28. The ink jet recording apparatus of claim 26, wherein:

the support member is formed from a transfer member that supports and transfers the recording medium in a front-rear direction with respect to the front portion of the ink jet recording apparatus; and a front end of the transfer member is located before a rear end of the discharge port.

29. The ink jet recording apparatus of claim 26, wherein at least a lower portion of the first cover body is composed of a soft material.

30. The ink jet recording apparatus of claim 26, wherein the first cover body is opened by being pushed from a rear of the first cover body by the recording medium.

31. The ink jet recording apparatus of claim 26, wherein a lower end of the first cover body is disposed below the support member.

32. The ink jet recording apparatus of claim 26, further comprising:

a passing aperture located within the apparatus casing and between the ultraviolet light irradiation device and the discharge port, the passing aperture configured for passing the recording medium; and a second cover body that is rotatable with an upper portion of the apparatus casing and covers at least a portion of the passing aperture in a freely openable and a freely closeable manner, wherein the second cover body is opened while a lower portion of the second cover body contacts an upper surface of the recording medium when the recording medium passes through the passing aperture.

33. The ink jet recording apparatus of claim 32, wherein:

the lower portion of the first cover body extends below a lower edge of the discharge port and overlaps an exterior surface of the apparatus casing; and the lower portion of the second cover body is positioned above a lower edge of the passing aperture.

34. An ink jet recording apparatus comprising:

an apparatus casing comprising a discharge port that opens in a forward direction with respect to a front portion of the ink jet recording apparatus;

a support member disposed within the apparatus casing and in the rear of the discharge port and comprising a plane section configured to support a recording medium;

an ink head disposed within the apparatus casing and configured to elect ink that is curable with ultraviolet light onto the recording medium;

an ultraviolet light irradiation device disposed within the apparatus casing and configured to irradiate ultraviolet light onto the recording medium;

a first cover body attached to the apparatus casing and configured to cover the discharge port such that the first cover body is freely opened and freely closed by a rotation using an upper portion of the first cover body as a pivot for the rotation; and a passage that is located within the apparatus casing and between the ultraviolet light irradiation device and the discharge port, the passage configured to pass the recording medium and comprising a pair of plate-like members that are disposed such that one is below the other and separated from each other by a predetermined gap, wherein:

the discharge port is located on a virtual plane defined by forwardly extending the plane section of the support member; and the first cover body is opened while a lower portion of the first cover body contacts an upper surface of the recording medium when the recording medium is discharged through the discharge port.

35. An ink jet recording apparatus comprising:

an apparatus casing comprising a discharge port that opens in a forward direction with respect to a front portion of the ink jet recording apparatus;

a support member disposed within the apparatus casing and in the rear of the discharge port and configured to support a recording medium;

a guide plate having an arch-shaped cross-section and located at a front end section of the support member;

an ink head disposed within the apparatus casing and configured to eject ink curable with ultraviolet light onto the recording medium;

an ultraviolet light irradiation device disposed within the apparatus casing such that the ultraviolet light irradiation device is freely moveable in a left-right direction with respect to the front portion of the ink jet recording apparatus, the ultraviolet light irradiation device configured to irradiate ultraviolet light onto the recording medium; and a transfer device configured to transfer the recording medium in a front-rear direction with respect to the front portion of the recording apparatus, wherein the transfer device transfers the recording medium when at least a portion of the ultraviolet light irradiation device is positioned to a left side or a right side of the discharge port.

36. An ink jet recording apparatus comprising:

an apparatus casing comprising a discharge port that opens in a forward direction with respect to a front portion of the ink jet recording apparatus;

a support member disposed within the apparatus casing and in the rear of the discharge port and comprising a plane section configured to support a recording medium;

a guide plate having an arch-shaped cross-section and located at a front end section of the support member;

an ink head disposed within the apparatus casing and configured to eject ink curable with ultraviolet light onto the recording medium; and an ultraviolet light irradiation device disposed within the apparatus casing and configured to irradiate ultraviolet light onto the recording medium, wherein the discharge port is located on a virtual plane defined by forwardly extending the plane section of the support member.

* * * * *